US010195658B1

(12) United States Patent
Gilliam

(10) Patent No.: US 10,195,658 B1
(45) Date of Patent: Feb. 5, 2019

(54) CROWN CAP FABRICATION METHOD

(71) Applicant: James R. Gilliam, Clearwater, FL (US)

(72) Inventor: James R. Gilliam, Clearwater, FL (US)

( * ) Notice: Subject to any disclaimer, the term of this patent is extended or adjusted under 35 U.S.C. 154(b) by 291 days.

(21) Appl. No.: 15/357,377

(22) Filed: Nov. 21, 2016

Related U.S. Application Data

(63) Continuation-in-part of application No. 13/590,732, filed on Aug. 21, 2012, now Pat. No. 9,499,311, which is a continuation-in-part of application No. 13/405,910, filed on Feb. 27, 2012, now Pat. No. 9,415,905, and a continuation-in-part of application No. 12/583,104, filed on Aug. 14, 2009, now abandoned, which is a continuation-in-part of application No. 12/387,618, filed on May 5, 2009, now abandoned.

(51) Int. Cl.

| | |
|---|---|
| ***B21D 51/48*** | (2006.01) |
| ***B65B 7/28*** | (2006.01) |
| ***B65D 41/12*** | (2006.01) |
| ***B21D 19/12*** | (2006.01) |

(52) U.S. Cl.
CPC ..... *B21D 51/48* (2013.01); *B21D 19/12* (2013.01); *B65B 7/285* (2013.01); *B65D 41/12* (2013.01)

(58) Field of Classification Search
CPC ..... B65D 41/28; B65D 41/10; B65D 41/105; B65D 41/12
USPC ..... 53/488
See application file for complete search history.

(56) References Cited

U.S. PATENT DOCUMENTS

| | | | | |
|---|---|---|---|---|
| 2006/0041448 | A1* | 2/2006 | Patterson | G06Q 10/101 705/301 |
| 2013/0155723 | A1* | 6/2013 | Coleman | G02B 6/0018 362/621 |

* cited by examiner

*Primary Examiner* — Lori Baker

(57) ABSTRACT

The first step is positioning a first die adjacent to the intermediate extent, the first die having a first radius of curvature, the first die being positioned adjacent to the free edge. The next step is activating the first die to create a primary curl in the intermediate extent. The next step is positioning a second die adjacent to the intermediate extent, the second die having a second radius of curvature, the second die being positioned adjacent to the primary curl. The last step is activating the second die to create a secondary curl.

5 Claims, 3 Drawing Sheets

CROWN CAP FABRICATION METHOD

RELATED APPLICATION

The present application is a continuation in part of application Ser. No. 13/590,732, filed Dec. 13, 2012 issued Nov. 22, 2016 as U.S. Pat. No. 9,499,311 which is a continuation-in-part of now abandoned application Ser. No. 12/583,104 filed Aug. 14, 2009, and is a continuation-in-part of application Ser. No. 13/405,910 filed Jul. 27, 2012 issued Aug. 16, 2016 as U.S. Pat. No. 9,415,905 which is in turn a continuation-in-part of abandoned application Ser. No. 12/387,618 filed May 5, 2009, the subject matter of which applications is incorporated herein by reference and the priority of which is claimed.

BACKGROUND OF THE INVENTION

Field of the Invention

The present invention relates to a crown cap fabrication method and more particularly pertains to curling the free end of a crown cap for greater stability.

Description of the Prior Art

The use of crown caps is known in the prior art. More specifically, crown caps previously fabricated and devised and utilized for the purpose of sealing bottles are known to consist basically of familiar, expected, and obvious structural configurations, notwithstanding the myriad of designs encompassed by the crowded prior art which has been developed for the fulfillment of countless objectives and requirements.

While the known devices and methods fulfill their respective, particular objectives and requirements, they do not describe a crown cap fabrication method that allows curling the free end of a crown cap.

In this respect, the crown cap fabrication method according to the present invention substantially departs from the conventional concepts of the prior art, and in doing so provides a method primarily developed for the purpose of strengthening crown caps through successively curling free ends of crown caps.

Therefore, it can be appreciated that there exists a continuing need for a new and improved crown cap fabrication method which can be used for curling free ends of crown caps in excess of 360 degrees. In this regard, the present invention substantially fulfills this need.

SUMMARY OF THE INVENTION

In view of the disadvantages inherent in the known types of crown caps now present in the prior art, the present invention provides an improved crown cap fabrication method. As such, the general purpose of the present invention, which will be described subsequently in greater detail, is to provide a new and improved crown cap fabrication method and method which has all the advantages of the prior art and none of the disadvantages.

To attain this, for a broad perspective, the present invention essentially comprises a first step of providing a crown cap having an imperforate cover, and a free edge, and an intermediate extent between the imperforate cover and the free edge. The next step is positioning a first die adjacent to the intermediate extent, the first die having a first radius of curvature, the first die being positioned adjacent to the free edge. The next step is activating the first die to create a primary curl in the intermediate extent. The next step is positioning a second die adjacent to the intermediate extent, the second die having a second radius of curvature, the second die being positioned adjacent to the primary curl. The final step is activating the second die to create a secondary curl.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved crown cap fabrication method which has ail of the advantages of the prior art crown cap fabrication methods and none of the disadvantages.

It is a further object of the present invention to provide a new and improved crown cap fabrication method which provides crown caps of durable and reliable constructions.

An even further object of the present invention is to provide a new and improved crown cap fabrication method which is susceptible of a low cost of manufacturing crown caps with regard to both materials and labor.

Lastly, it is an object of the present invention to provide a crown cap fabrication method for strengthening crown caps.

These together with other objects of the invention, along with the various features of novelty which characterize the invention, are pointed out with particularity in the claims annexed to and forming a part of this disclosure.

For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various Figures.

DESCRIPTION OF THE PREFERRED EMBODIMENT

Figure 1:
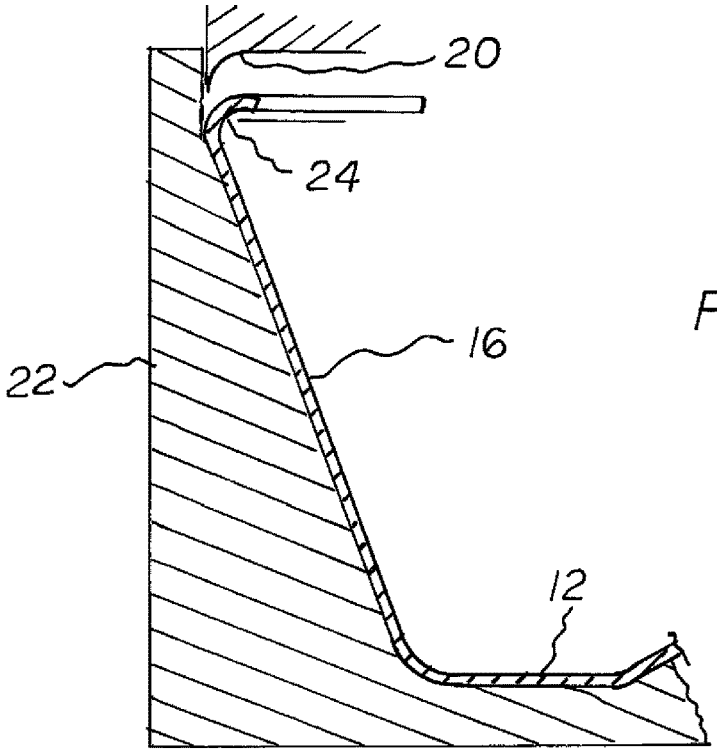
FIG. 1 is a cross sectional view of a portion of a crown cap prior to performing the primary method curling step of the present invention.
Figure 2:
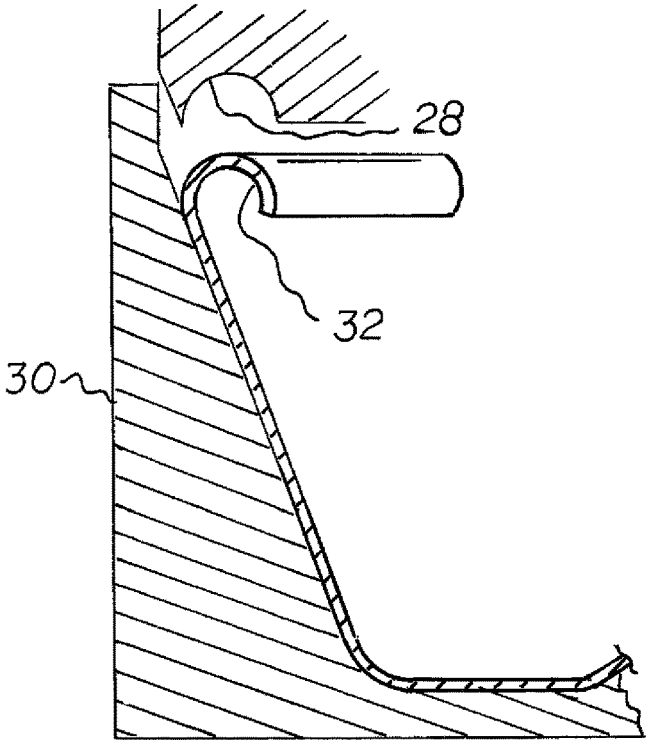
FIG. 2 is a cross sectional view of a portion of the crown after performing the secondary curling step of the present invention.
Figure 3:
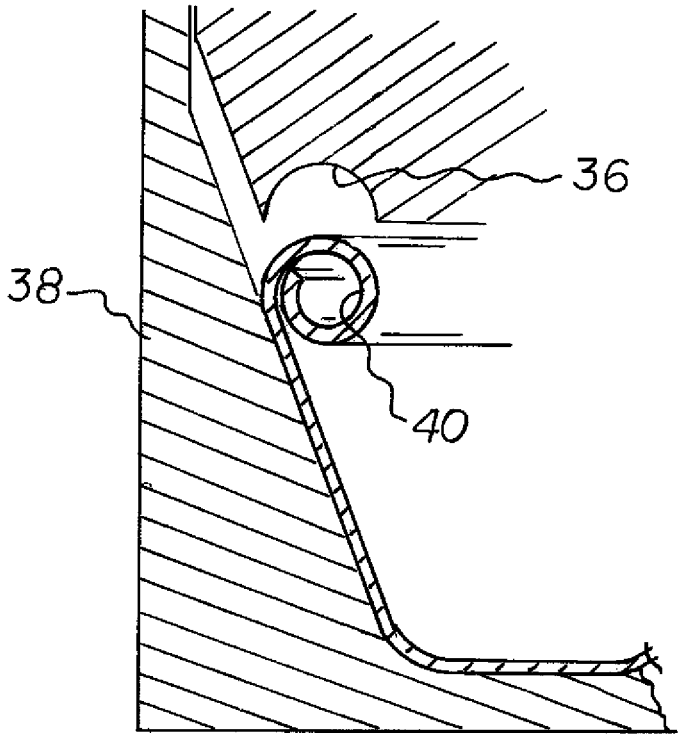
FIG. 3 is a cross sectional view of a portion of the crown cap of FIG. 2 after performing the tertiary curling step of the present invention.
Figure 4:
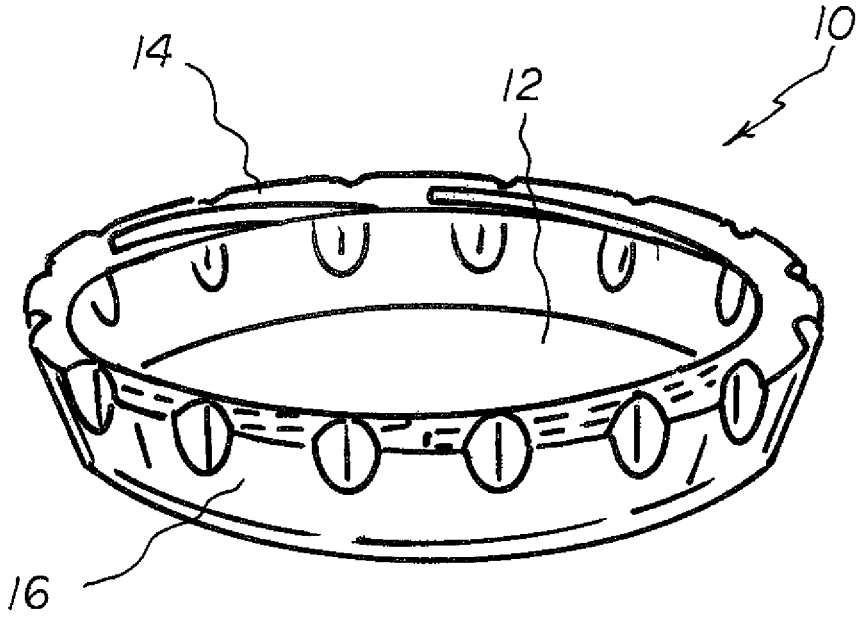
FIG. 4 is a perspective illustration of a crown cap with the curl on the free end prior to crimping onto a bottle.

With reference now to the drawings, and in particular to FIG. 1 thereof, the preferred embodiment of the new and improved crown cap fabrication method embodying the principles and concepts of the present invention and generally designated by the reference numeral 10 will be described.

The present invention, the crown cap method is comprised of a plurality of steps. Such steps in their broadest context include successively curling intermediate sections of a crown cap to create a curl in excess of 360 degrees. Such steps are individually configured and correlated with respect to each other so as to attain the desired objective.

From a specific perspective, the invention of the present application is a method for curling the free end of a crown cap 10 for increased stability. The method includes plural steps.

The first step is providing the crown cap 10. The crown cap has an imperforate cover 12 in a circular configuration. The crown cap has a free edge 14. The crown cap has an intermediate extent 16 of 6 millimeters, plus or minus 10 percent, between the imperforate cover and the free edge.

The next step is positioning a first male die 20 on the inside of the intermediate extent and positioning a first female die 22 on the outside of the intermediate extent facing the first male die. The first male and female dies have a curvature of 30 degrees, plus or minus 10 percent. The first male and female dies are positioned to contact 6 millimeters, plus or minus 10 percent, to the intermediate extent from the free edge.

The next step is pressing together the first male and female dies to create a primary curl 24.

The next step is positioning a second male die 28 on the inside of the intermediate extent and positioning a second female die 30 on the outside of the intermediate extent facing the second male die. The second male and female dies have a curvature of 90 degrees, plus or minus 10 percent. The second male and female dies are positioned to contact the intermediate extent from the primary curl.

The next step is pressing together the second male and female dies to create a secondary curl 32.

The next step is positioning a third male die 36 on the inside of the intermediate extent and positioning a third female die 38 on the outside of the intermediate extent facing the third male die. The third male and female dies have a curvature of 270 degrees, plus or minus 10 percent. The third male and female dies are positioned to contact the intermediate component from the secondary curl.

The next step is pressing together the third male and female dies to create a tertiary curl 40. The primary and secondary and tertiary curls together exceed 380 degrees.

The final method step is crimping the crown cap with the curled free edge onto a bottle.

The preferred die is a curl die.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the SPECIFICATION are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A crown cap fabrication method comprising the steps of:

positioning a first die adjacent to an intermediate extent of a crown cap, the first die having a first radius of curvature, the first die being positioned adjacent to a free edge of the crown cap;

activating the first die to create a primary curl in the intermediate extent;

positioning a second die adjacent to the intermediate extent, the second die having a second radius of curvature, the second die being positioned adjacent to the primary curl; and activating the second die to create a secondary curl.

2. The system as set forth in claim 1 and further including the step of:

positioning a third die adjacent to the intermediate extent, the third die having a third radius of curvature, the third die being positioned adjacent to the secondary curl; and activating the third die to create a tertiary curl.

3. The system as set forth in claim 2 wherein the third radius of curvature and the second radius of curvature is greater than the first radius of curvature.

4. The system as set forth in claim 1 wherein dies are curl dies.

5. A method for curling the free end of a crown cap for increased stability comprising the steps of:

providing the crown cap, the crown cap having an imperforate cover in a circular configuration, the crown cap having a free edge, the crown cap having an intermediate extent of 6 millimeters between the imperforate cover and the free edge;

positioning a first male die on the inside of the intermediate extent and positioning a first female die on the outside of the intermediate extent facing the first male die, the first male and female dies having a curvature of 30 degrees, plus or minus 10 percent, the first male and female dies being positioned to contact the intermediate extent from the free edge;

pressing together the first male and female dies to create a primary curl;

positioning a second male die on the inside of the intermediate extent and positioning a second female die on the outside of the intermediate extent facing the second male die, the second male and female dies having a radius of curvature of 90 degrees, plus or minus 10 percent, the second male and female dies being positioned to contact the intermediate extent from the primary curl;

pressing together the second male and female dies to create a secondary curl;

positioning a third male die on the inside of the intermediate extent and positioning a third female die on the outside of the intermediate extent facing the third male die, the third male and female dies having a curvature of 270 degrees, plus or minus 10 percent;

pressing together the third male and female dies to create a tertiary curl, the primary and secondary and tertiary curls together exceeding 360 degrees; and crimping the crown cap with the curled free edge onto a bottle.

* * * * *